US007577393B2

(12) United States Patent
Suzuki et al.

(10) Patent No.: US 7,577,393 B2
(45) Date of Patent: Aug. 18, 2009

(54) IMAGE FORMING APPARATUS AND PROGRAM FOR CONTROLLING AN IMAGE FORMING APPARATUS

(75) Inventors: Chikatsu Suzuki, Hachioji (JP); Kenji Taki, Hino (JP); Fusako Akimoto, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 415 days.

(21) Appl. No.: 11/339,503

(22) Filed: Jan. 26, 2006

(65) Prior Publication Data

US 2006/0239731 A1 Oct. 26, 2006

(30) Foreign Application Priority Data

Apr. 22, 2005 (JP) ..... 2005-125160

(51) Int. Cl.
*G03G 15/00* (2006.01)

(52) U.S. Cl. ..... 399/389; 399/370; 400/624

(58) Field of Classification Search ..... 399/389, 399/370; 400/624–629
See application file for complete search history.

(56) References Cited

U.S. PATENT DOCUMENTS 6,516,178 B2 * 2/2003 Fukushima ..... 399/376

FOREIGN PATENT DOCUMENTS

JP 2001341899 A * 12/2001

* cited by examiner

*Primary Examiner*—Daniel J Colilla
*Assistant Examiner*—Allister Primo
(74) *Attorney, Agent, or Firm*—Finnegan, Henderson, Farabow, Garrett & Dunner, L.L.P.

(57) ABSTRACT

There is described an image forming apparatus comprising a tray that outputs information by which various kinds of fixed form sized of recording mediums can be discriminated and a controller to acquire a approximate size of a recording medium having an unfixed form size by conducting an operation for detecting a fixed form size of the recording medium by referring to the information if the recording medium having the unfixed form size is stacked on the tray, wherein, according to the approximate size, the controller controls an operation for displaying information corresponding to unfixed form size or sizes registered in advance.

2 Claims, 9 Drawing Sheets

FIG. 9

| HORIZONTAL CATEGORY \ VERTICAL CATEGORY | | I | II | III |
|---|---|---|---|---|
| | | 200mm | 300mm | 400mm |
| A | - 100 | NON - FIXED FORM(1) : 80X180 | NON - FIXED FORM(6) : 80X250 | NON - FIXED FORM(9) : 80X350 |
| B | 101 - 200 | NON - FIXED FORM(2) : 150X180<br>NON - FIXED FORM(3) : 170X180<br>NON - FIXED FORM(4) : 180X190 | NON - FIXED FORM(7) : 150X250 | NON - FIXED FORM(10) : 150X350 |
| C | 201- | NON - FIXED FORM(5) : 220X180 | NON - FIXED FORM(8) : 220X250 | NON - FIXED FORM(11) : 220X350 |

IMAGE FORMING APPARATUS AND PROGRAM FOR CONTROLLING AN IMAGE FORMING APPARATUS

This application is based on Japanese Patent Application NO. 2005-125160 filed on Apr. 22, 2005 in Japanese Patent Office, the entire content of which is hereby incorporated by reference.

BACKGROUND OF THE INVENTION

The present invention relates to image forming apparatuses that can handle recording sheets of non-fixed form (hereinafter, also referred to as non-standard) sizes.

In an image forming apparatus which forms images such as toner images on recording sheets, in the case of a fixed form (hereinafter, also referred to as standard) size recording sheet, for the size information related to the length and breadth of a recording sheet, generally the size information detected automatically in the sheet feeding tray (hereinafter, referred to merely as a tray) on which recording sheets are stacked is used.

Further, such type of trays have sensors placed at positions at which it is possible to detect the sizes of fixed form size recording sheets, and the information of these sensors is output to the main unit side of the image forming apparatus. Therefore, the size of the recording sheet is not being detected accurately but is one that discriminates between different fixed form sizes based on the rough detection result.

Further, it is also possible to use non-fixed form size recording sheets other than fixed form size sheets.

Therefore, there are even image forming apparatuses that have trays for loading non-fixed form size recording sheets, and when non-fixed form size recording sheets are loaded, it is possible to set that the tray is a non-fixed form size tray.

Further, if there is any error in the input or setting of the size of the recording sheet when using non-fixed form size recording sheets in this manner, this can cause problems such as jamming at the time of feeding or conveying the sheets.

In view of this, methods have proposed as set forth in Patent Document 1 through Patent Document 3 shown below when such non-fixed form size recording sheets are loaded in the tray.

[Patent Document 1]

Tokkai 2000-125083 (Japanese Non-Examined Patent Publication)

[Patent Document 2]

Tokkaihei 6-23942 (Japanese Non-Examined Patent Publication)

[Patent Document 3]

Tokkaihei 11-79472 (Japanese Non-Examined Patent Publication)

In Patent Document 1 above, the user measures beforehand the size of the recording sheet and sets in the main unit of the apparatus the recording sheet size data for each tray (numerical input). Next, when sheets are loaded in the tray for which the selection has been made that the tray is a non-fixed form size tray, the size data set for each tray in the main unit of the apparatus is referred to at the time of sheet feeding.

Further, in Patent Document 2 mentioned above, the transfer sheet is placed first on the platen and scanned thereby measuring the size of the sheet. In this case, it is necessary that the apparatus is a copying machine provided with a scanner, and also, this requires the tedious tasks of placing the recording sheet on the platen and of scanning it.

Further, in Patent Document 3 mentioned above, the size of the recording sheet is measured by passing the transfer sheet through the image forming apparatus without forming images on it. In this case, a new sensor will become necessary to measure the size accurately in the main scanning direction, and it is necessary to output a blank recording sheet.

In this manner, it is possible to obtain the size of a non-fixed form size recording sheet using the techniques given in Patent Documents 1 to 3 mentioned above. However, the setting of the size of a non-fixed form size recording sheet in an image forming apparatus is normally done for each tray. Therefore, for example, when wanting to use non-fixed form size recording sheets of the same size in all the plurality of trays provided in the image forming apparatus, in spite of different problems such as the above being present, it is necessary to obtain the size of the non-fixed form size recording sheets several times. In addition, for example, after setting the size of a non-fixed form size recording sheet for a certain tray, if recording sheets of a size different from the set size are used in that tray, and even in the case when again non-fixed form size sheets of the size set previously are to be used, in spite of different problems such as the above being present, it is necessary to obtain the size of the non-fixed form size recording sheets.

Further, although it is possible to solve this problem by placing sensors that can accurately measure the size of even non-standard sheets in the tray, there will be problems that arise such as the increase in the cost due to the addition of sensors to the trays or of adopting sensors that can measure accurately, or the increase in cost for taking measures in the main unit of the image forming apparatus to receive the data from the trays.

SUMMARY OF THE INVENTION

To overcome the abovementioned drawbacks in conventional image forming apparatus, it is an object of the present invention to provide an image forming apparatus, in which the non-fixed form size recording medium is usable and which makes it possible to easily implement the acquiring operation of the size information.

Accordingly, the abovementioned object of the present invention can be attained by an image forming apparatus and a program described as follow.

An image forming apparatus for forming an image on a recording medium based on image data to output said recording medium on which said image is formed, comprising:

a tray on which said recording medium can be stacked and that outputs information by which various kinds of fixed form sizes of recording mediums can be discriminated; and a controller to acquire a approximate size of a recording medium having an unfixed form size by conducting an operation for detecting a fixed form size of said recording medium by referring to said information outputted from said tray if said recording medium having said unfixed form size is stacked on said tray, wherein, according to said approximate size, said controller controls an operation for displaying information corresponding to unfixed form size or sizes registered in advance.

A computer program for executing controlling operations of an image forming apparatus for forming an image on a recording medium based on image data to output said recording medium on which said image is formed, said computer program comprising the functional steps of:

outputting information, by which various kinds of fixed form sizes of recording mediums can be discriminated, from a tray on which said recording mediums can be stacked;

acquiring a approximate size of a recording medium having an unfixed form size by conducting an operation for detecting a fixed form size of said recording medium by referring to said information outputted by said tray, if said recording medium having said unfixed form size is stacked on said tray; and controlling an operation for displaying information corresponding to unfixed form size or sizes registered in advance, according to said approximate size.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 9 shows a table to be referred by a CPU at the time of executing Step S4 shown in FIG. 2.

DETAILED DESCRIPTION OF THE PREFERRED EMBODIMENT

Some preferred embodiments (herein after referred to as embodiments) for implementing the present invention are described in detail below with reference to the drawings.

Figure 1:
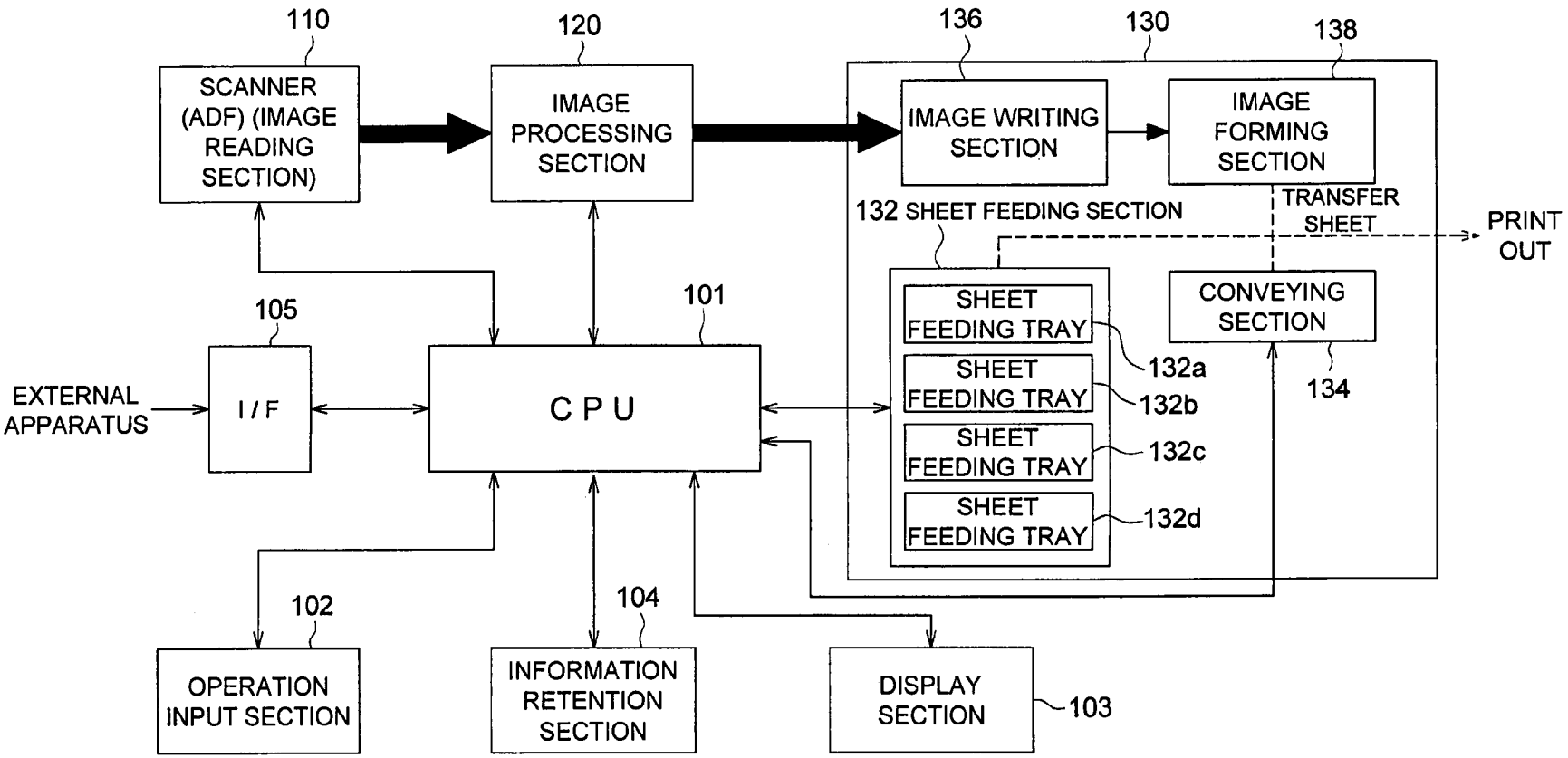
FIG. 1 shows a block diagram of an electrical configuration of an image forming apparatus embodied in the present invention.
Figure 3:
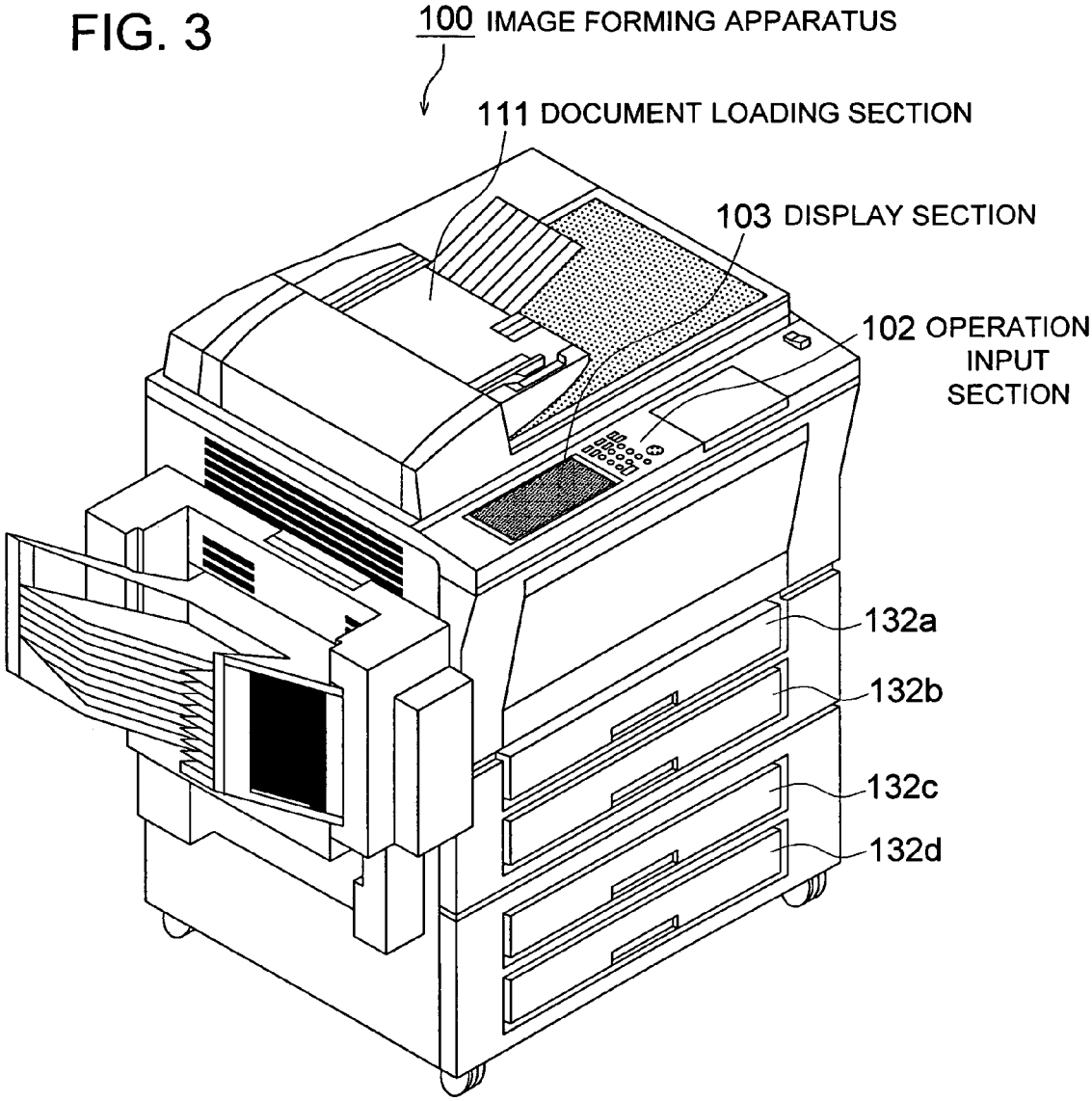
FIG. 3 shows a perspective view of a mechanical configuration of an image forming apparatus embodied in the present invention.

FIG. 1 is a circuit configuration diagram showing the electrical configuration of the copying machine as an image forming apparatus according to a first embodiment of the present invention. Also, FIG. 3 is a perspective view diagram showing the external appearance of a copying machine to which an image forming apparatus according to the present embodiment of the present invention can be applied.

In FIG. 1, 101 is a CPU that controls the entire apparatus as a control section, 102 is an operation input section through which the user or the operator inputs the operations of setting the image forming apparatus, and 103 is a display-section that displays the status of the apparatus to the user or the operator. Further, although the input of operations and the display are shown here as being made separately by an operation input section and a display section, the configuration can also be of an operation and display section that carries out both of these functions. Further, 104 is an information retention section that retains various types of information related to the image forming apparatus.

105 is an interface (I/F) for sending and receiving various types of data to and from external apparatuses. Also, this interface 105 can be one that is connected to external apparatuses directly by a cable, or can use a network in between.

110 is a scanner that optically scans the image information of the document and generates the image data, and is configured by providing with an image reading section that scans the image of the document and generates the image data and an automatic document feeder (ADF) section that automatically feeds and conveys the document sheets to this image reading section. In addition, two types of scanning is possible in this scanner 110, one type in which the scanning is made while automatically feeding and conveying the document placed on the document loading section 111 (see FIG. 3) and the image data is generated, and the other type in which the scanning is done of one sheet of the document placed by the user on a platen glass at a time and the image data is generated. Here, when the document is placed with its surface to be read out facing down on the platen glass, the reading optical system scans along the platen glass and reads the document. Further, when the document is fed and conveyed automatically, the reading optical system carries out the reading in a fixed state.

120 is an image processing section that carries out prescribed image processing operations on the image data read out by the scanner 110, and can also be provided with an image memory of a prescribed capacity in order to retain the image data according to the need. The image memory here can not only be a semiconductor memory but also can be a hard disk drive unit.

130 is a print engine that forms images (toner images) according to the image data on the recording sheet and outputs it, and is configured to include a sheet feeding section 132 that feeds to the image forming section the desired recording sheet from among the sheet feeding trays (sheet feeding trays 132*a* to 132*d*), a conveying section 134 that conveys the fed recording sheet at a prescribed speed, an image writing section 136 that generates a laser beam in accordance with the image data, and an image forming section 138 that generates a toner image from the latent image according to the laser beam and transfers it onto the recording sheet.

Here, recording sheets of respective prescribed sizes are loaded in the sheet feeding trays 132*a* to 132*d* (see FIG. 3), and it is possible to load in these trays not only sheets of fixed form sizes such as A4, B4, A4R, etc., but also non-fixed form size sheets that cannot be classified into any of the fixed form sizes.

Further, in the present embodiment, it is possible to load non-fixed form size recording sheets in each sheet feeding tray, and when non-fixed form size sheets are loaded in a sheet feeding tray, it is assumed that it is possible to set in the main unit of the image forming apparatus the tray is a non-fixed form size tray when non-fixed form size sheets are loaded in it. Further, the setting of a non-fixed form size tray in the present embodiment implies the setting of loading non-fixed form size recording sheets in that tray. In addition, each sheet feeding tray is configured so that it outputs information from which it is possible to identify the size of the recording sheet of among the fixed form sizes.

Figure 4:
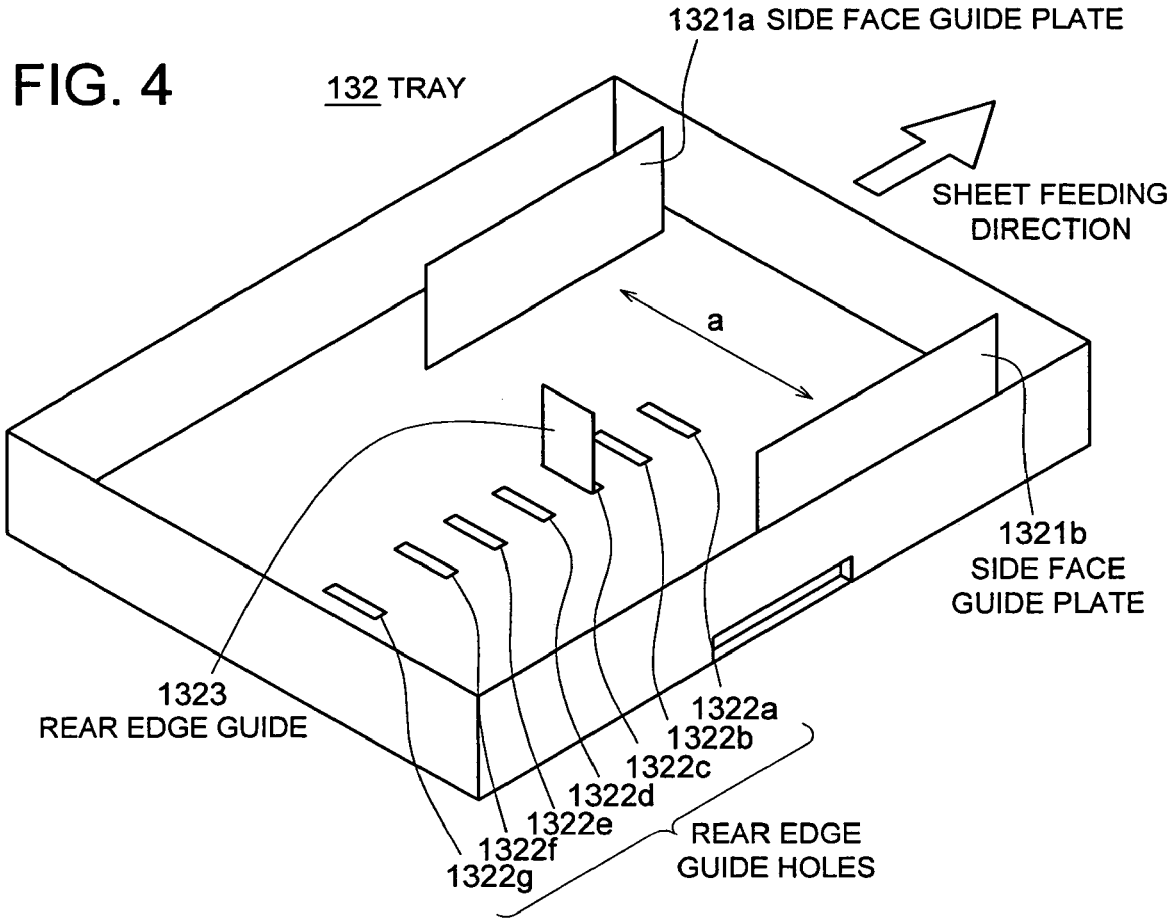
FIG. 4 shows an explanatory drawing of a tray structure employed in an image forming apparatus embodied in the present invention.

Here, as is shown in FIG. 4, the sheet feeding tray 132 is provided with side face guide plates 1321*a* and 1321*b* that restrict the recording sheets in the width direction of the recording sheet (see FIG. 4*a*) which is at right angles to the sheet feeding direction. These side face guide plates 1321*a* and 1321*b* can be moved freely in the width direction of the recording sheet to suit the recording sheet, and the data along the width direction of the recording sheet posted to the main unit of the image forming apparatus as a continuous change in the resistance value using a variable resistor, etc.

Further, at the rear edge along the sheet feeding direction (the longitudinal direction of the recording sheet), as a choice for the position matching with the longitudinal direction of the recording sheet, the rear edge guide holes 1322*a* to 1322*g* are provided for installing the rear edge guide 1323. Further, the position information of the rear edge guide installed in any one of the rear edge guide holes is posted to the main unit of the image forming apparatus as a rough position information for discriminating a fixed form size.

For example, although the width of the recording sheet is the same in the cases recording sheets of sizes A4R and A5, the lengths of the recording sheets is very much different in these two sizes of recording sheets. Therefore, the data in the longitudinal direction of the recording sheet can be discriminated without any problems even when the resolution is rough. In a similar manner, although the widths are the same in the case of recording sheets of sizes B4R and B5, and of sizes A3 and A4, since the lengths of the recording sheets are different to a large extent, the data in the longitudinal direction of the recording sheet can be discriminated without any problems even when the resolution is rough.

Therefore, from this continuous data in the width direction of the recording sheet from the sheet feeding tray 132 and the data with a rough resolution in the longitudinal direction of the recording sheet, it is possible in this configuration to discriminate between the different sizes of the recording sheet with fixed form sizes in the main unit of the image forming apparatus.

Further, even when the rear edge guide holes have been provided in more detail in order to correspond to recording sheets of non-fixed form sizes in this case, for the longitudinal direction of the recording sheets, it is sufficient if a rough position information that is the minimum necessary for detecting the above fixed form sizes can be output.

First Operation Example

In the following, the operation of an image forming apparatus according to the present embodiment is described as a first example of operation referring to the flow chart of FIG. 2. Here, the operation is explained when new recording sheets are loaded in a tray loaded originally with non-fixed form size recording sheets.

To begin with, in the image forming apparatus, it is possible to load non-fixed form size recording sheets in any tray, and it is assumed that a setting that a tray is a "non-fixed form size tray" has been made as the one in which non-fixed form size recording sheets are loaded. This setting as a non-fixed form size tray is retained in the information retention section 104 by the CPU 101 as a tray attribute data indicating which tray is a non-fixed form size tray.

Figure 2:
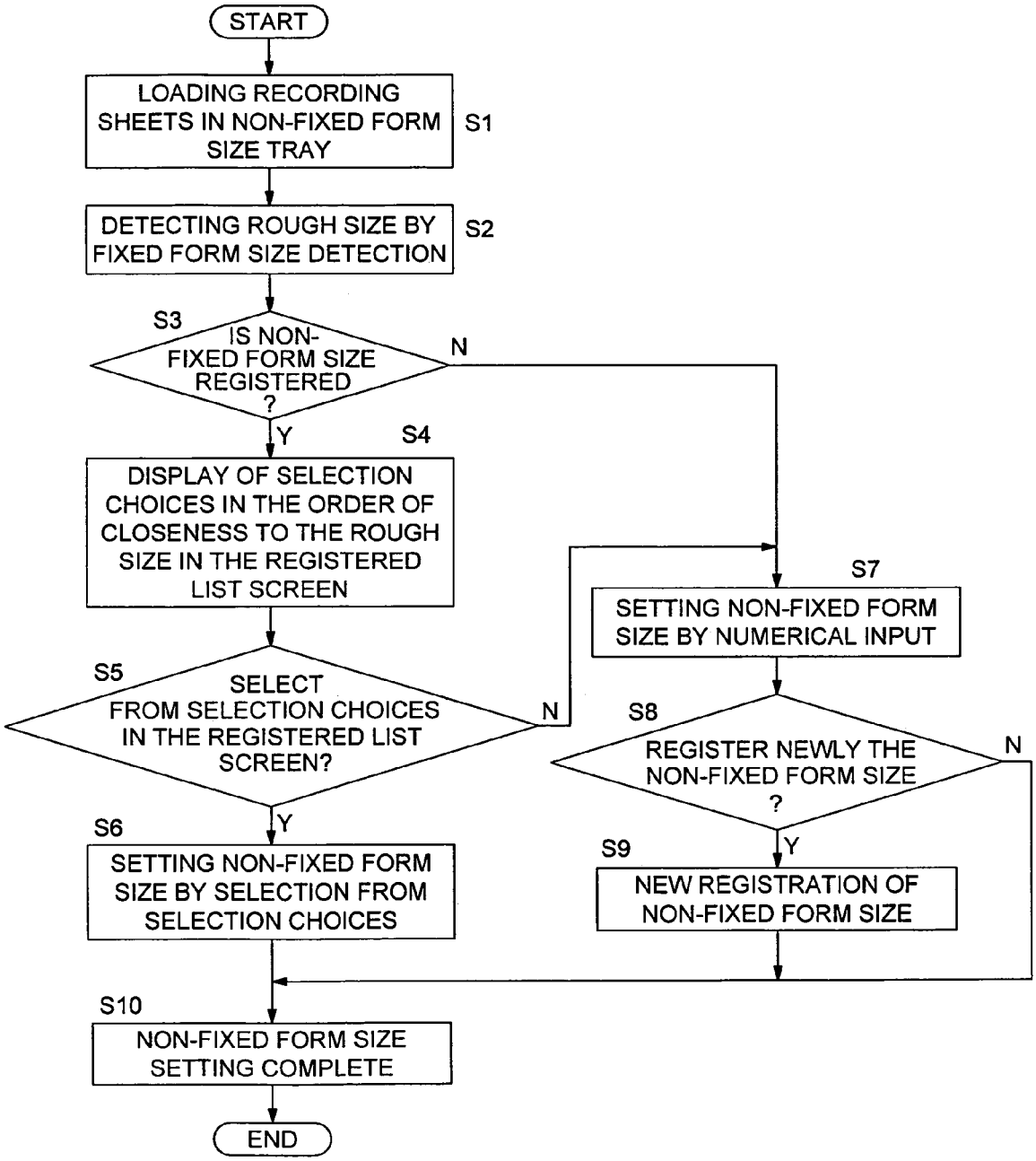
FIG. 2 shows a flowchart of operations performed in an image forming apparatus embodied in the present invention.

Here, consider that the user loads recording sheets in a non-fixed form size tray of the image forming apparatus (S1 in FIG. 2). Further, the "user" here is not limited to the actual user of the image forming apparatus, but denotes any and all persons who can carry out the work of replenishing recording sheets in the location where that image forming apparatus is installed.

The CPU 101 that has detected the drawing out and insertion of the non-fixed form size tray from the main unit of the image forming apparatus, if recording sheets are present in that tray, carries out a fixed form size detection for the recording sheets in that tray. In other words, using the continuous data along the width direction of the recording sheet from the non-fixed form size tray and from the rough resolution data along the longitudinal direction of the recording sheet, the CPU 101 carries out size detection (S2 in FIG. 2) in order to identify the size of fixed form size recording sheets. Further, here, since non-fixed form size recording sheets have been loaded in a non-fixed form size tray, the fixed form size detection at this stage actually becomes a "rough size detection" of non-fixed form size recording sheets.

Here, the CPU 101 checks if the registration of recording sheets of non-fixed form size has already been made (S3 in FIG. 2). In actuality, the CPU 101 checks if non-fixed form size registration data is present in the information retention section 104.

Here, if non-fixed form size recording sheet registration has already been made (Y in S3 in FIG. 2), the CPU 101 refers to the rough size of the non-fixed form size recording sheet obtained earlier by executing "rough size detection", and displays the non-fixed form sizes already registered as selection choices in an order nearest to the detected rough size (S4 in FIG. 2). Further, in this case, the non-fixed form sizes that are likely to be identical to the detected rough size and also that are in the order of closeness to the detected rough size are displayed as selection choices.

In this case, the CPU 101, first selects as a selection choice a non-fixed form size that is likely to be identical to the rough size detected using the continuous data along the width direction of the recording sheet from the non-fixed form size tray and from the rough resolution data along the longitudinal direction of the recording sheet. Next, the CPU 101, first refers to the continuous data along the width direction of the recording sheet from the non-fixed form size tray, and arranges the selection choices, from among the selection choices of non-fixed form sizes, so that they are in the order of closeness to the rough size.

Figure 5:
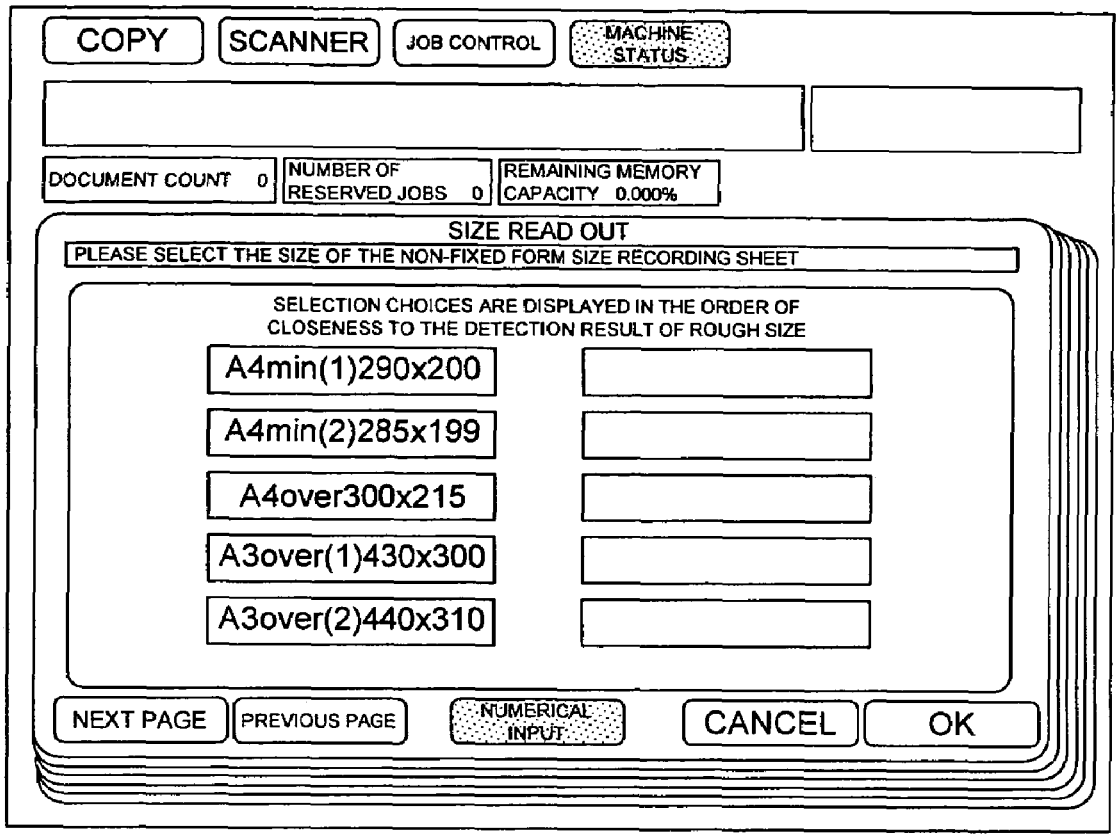
FIG. 5 shows an explanatory drawing indicating operations of an image forming apparatus embodied in the present invention.

For example, the CPU 101 not only displays in the display section 103 the non-fixed form sizes already registered, as a list screen of registered sizes as shown in FIG. 5, but also, from among those non-fixed form sizes, the non-fixed form sizes that are likely to be identical to the detected rough size and also that are in the order of closeness to the detected rough size are displayed as selection choices.

In this example of FIG. 5, five non-fixed form sizes have been registered with their names assigned as "A4min(1)290×200", "A4min(2)285×199", "A4over300×215", "A3over430×300", and "A3over440×310".

Further, in this example of FIG. 5, the example is that of the case when the rear edge guide 1323 has been provided at a position corresponding to A4 size, and three non-fixed form sizes "A4min(1)290×200", "A4min(2)285×199", and "A4over300×215", are the non-fixed form sizes that are likely to be identical to the detected rough size and are being displayed as selection choices in the active state, and also the display is being made of selection choices in the order of their closeness to the detected rough size.

Further, in this example of FIG. 5, the two non-fixed form sizes "A3over430×300" and "A3over440×310" are the non-fixed form sizes that do not match with the detected rough size, and although they are being displayed as selection choices in the non-active state, and it is also possible to make them not displayed in the display screen of selection choices.

Further, the CPU 101, for the selection choices displayed in the display section 103 in this manner, accepts inputs from the operation input section 102 or the touch panel which is integral with the display section 103, and when any one of the selection choices is selected by the user (Y in S5 in FIG. 2) and the 'OK' icon is clicked, carries out the setting of the selected selection choices as the size of the recording sheets loaded in the tray (S6 in FIG. 2).

As a result of this, during image formation using non-fixed form size recording sheets, since the non-fixed form sizes registered beforehand are displayed as selection choices in the order of closeness to the rough size detected by the recording sheet size detection and can be selected, it is possible to carry out easily the acquisition of non-fixed form sizes.

Further, if a selection is not made from among the selection choices displayed in the display section 103 in this manner (N in S5 in FIG. 2), the user clicks the "numerical input" icon near the bottom center in FIG. 5.

Figure 6:
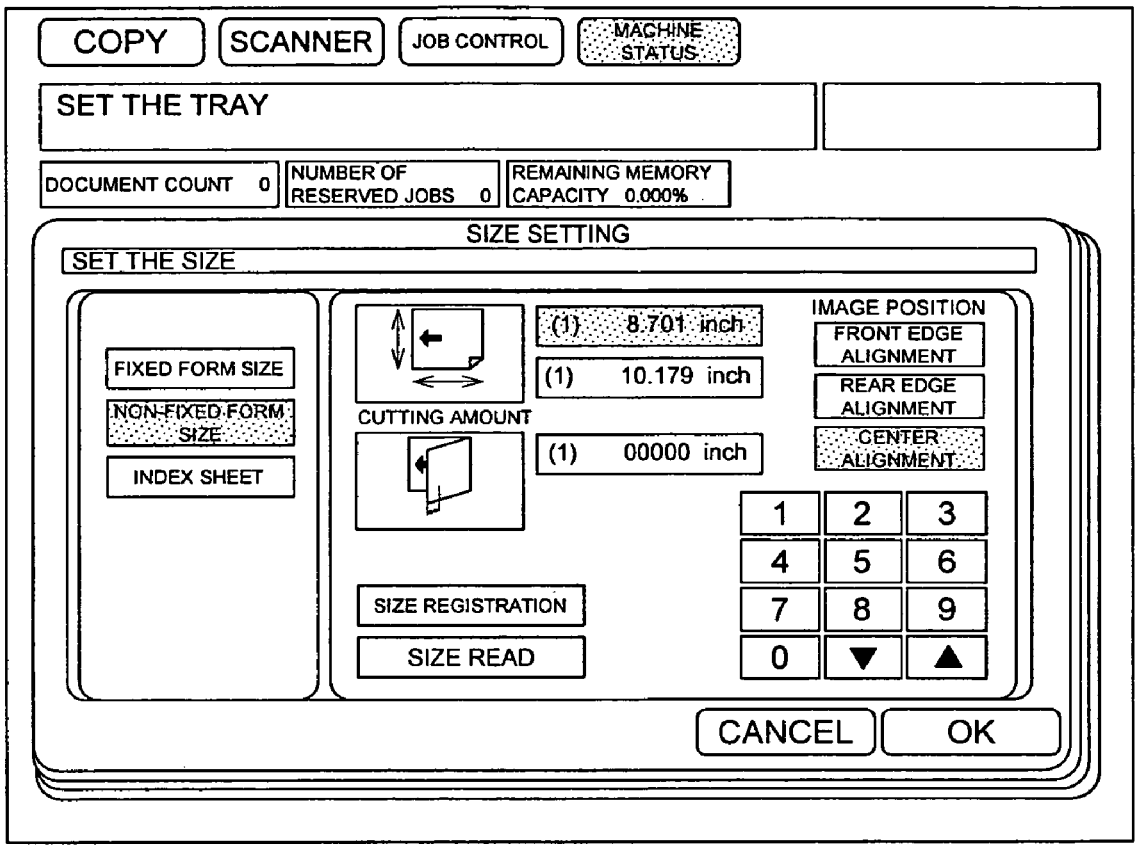
FIG. 6 shows an explanatory drawing indicating operations of an image forming apparatus embodied in the present invention.

In this case, the CPU 101, displays the numerical input screen as is shown in FIG. 6 in the display section 103, and accepts numerical inputs regarding the non-fixed form size from the operation input section 102 or the touch panel which is integral with the display section 103 (S7 in FIG. 2).

Further, according to the desire of the user (S8 in FIG. 2), it is also possible to carry out size registration (S9 in FIG. 2) for this non-fixed form size entered by numerical input. In other words, if the user desires that the non-fixed form size entered this time by numerical input has to be registered, the CPU 101 retains it as the registered data of non-fixed form sizes in the information retention section 104.

In the above manner, the CPU 101 completes the setting (S10 in FIG. 2) of the non-fixed form size regarding the size of the recording sheets loaded in the non-fixed form size tray either by selection among the selection choices displayed in the selection choices display screen, or by setting using numerical input.

Next, the Step S4 in FIG. 2 is described in detail as an example of the case in which the sizes that have been registered as the non-fixed form sizes are different from the size explained in the above operation example.

Further, in this example, the three holes 1323*a* to 1323*c* have been provided in the tray as the rear edge guide holes, and the respective holes correspond to 200 mm, 300 mm, and 400 mm as the size of the recording sheet in the longitudinal direction, and the data along the width direction of the recording sheet obtained by the side face guide plates 1321*a* and 1321*b* when the rear edge guide 1323 has been provided in the rear edge guide hole 1323*a* is 172 mm in this Figure.

Figure 8:
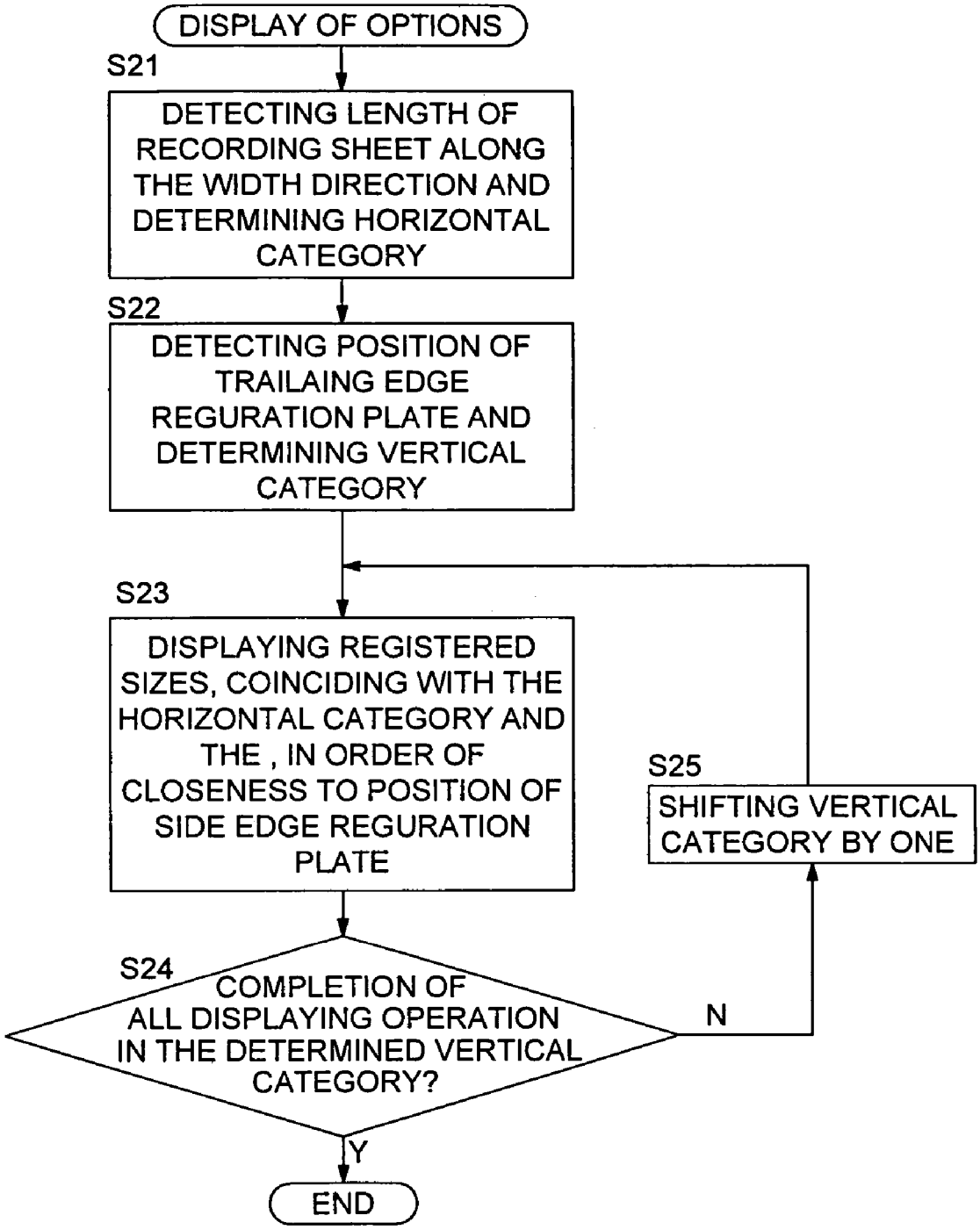
FIG. 8 shows a detailed flowchart of Step S4 shown in FIG. 2.

FIG. 8 is a flow diagram showing the details of Step S4. Further, FIG. 9 is a diagram showing the table referred to by the CPU 101 at the time of executing the Step S4. Further, the table shown in FIG. 9 is taken to be stored in a non-volatile memory, not shown in the figure, provided within the CPU 101. In addition, eleven types of sizes 'Non-standard (1)' to 'Non-standard (11)' (80×180 etc.) as the non-fixed form sizes have been stored with correspondence established to the names ('Non-standard (1)' to 'Non-standard (11)'). Further, each non-fixed form size is stored after categorizing into three horizontal categories of A to C depending on the length along the width direction of the recording sheet of the non-fixed form size, and categorizing into three vertical categories of I to III depending on the length in the longitudinal direction of the recording sheet.

As is shown in FIG. 8, the CPU 101 detects the length of the recording sheet along the width direction based on the data along the width direction of the recording sheet obtained by the side face guide plates 1321*a* and 1321*b*, judges to which horizontal category does the length along the width direction of the recording sheet belong, and determines the horizontal category (Step S21). In concrete terms, the table shown in FIG. 9 is referred to, a decision is made as to whether the length along the width direction of the recording sheet corresponds to the horizontal category A of the length being 100 mm or less, or to the horizontal category B of the length being more than 100 mm but less than or equal to 200 mm, or to the horizontal category C of the length being more than 200 mm. Here, since the data of the length along the width direction of the recording sheet is being indicated as 172 mm, the CPU 101 determines the horizontal category as B. Based on the decision of this horizontal category, the CPU 101 determines, among the non-fixed form sizes already registered, that the five types of non-fixed form sizes: non-fixed form size (2), non-fixed form size (3), non-fixed form size (4), non-fixed form size (7), and non-fixed form size (10) belonging to the horizontal category B are the non-fixed form sizes to be displayed.

Next, the CPU 101, based on the rough resolution data along the longitudinal direction of the recording sheet, judges to which vertical category does the length along the longitudinal direction of the recording sheet belong, and determines the vertical category (Step S22). In concrete terms, the table shown in FIG. 9 is referred to, a decision is made as to whether the length along the longitudinal direction of the recording sheet corresponds to the vertical category I of the length being equal to 200 mm, or to the vertical category II of the length being equal to 300 mm, or to the vertical category III of the length being equal to 400 mm. Here, since the data of the length along the longitudinal direction of the recording sheet is being indicated as 200 mm, the CPU 101 determines the vertical category as I.

Next, the CPU 101 displays the types of non-fixed form sizes (name and size) belonging to the vertical category I and the horizontal category B in the order of closeness to the length of the recording sheet along the width direction (Step S23). In other words, in this example of operation, the display is made in the sequence of non-fixed form size (3), non-fixed form size (4), and non-fixed form size (2). Next, a judgment is made as to whether the display of all non-fixed form sizes belonging to the horizontal category B determined in Step S21 has been completed (Step S24), and the operation is terminated if it is judged that the display has been completed. If the display is not judged to have been completed in Step S24, the horizontal category is shifted by one in the order of closeness to the length along the longitudinal direction of the recording sheet, and the Step S23 is executed. As a result, in this operation example, the selection choices are displayed in the sequence non-fixed form size (3), non-fixed form size (4), non-fixed form size (2), non-fixed form size (7), and non-fixed form size (10).

Further, in this example, although an example is explained of displaying only the types of non-fixed form sizes belonging to the horizontal category B, as was explained in FIG. 5, it is also possible to display the types of non-fixed form sizes belonging to other horizontal categories in the non-active state. In addition, as shown in this example, by displaying only the types of non-fixed form sizes belonging to the horizontal category B, it is possible to reduce the number of selection choices at the time the user selects the size, and hence it is possible to aim at higher increased efficiency of setting the non-fixed form size.

In the above manner, in image formation using recording sheets of non-fixed form sizes, since the non-fixed form sizes registered beforehand are displayed in the display section 103 as the selection choices in the order of closeness to the fixed form size detected by recording sheet size detection, and since the selection can be made from the operation input section 102, it is possible to execute easily the acquisition of non-fixed form sizes in an image forming apparatus such as a copying machine etc.

Further, because of the above operation, when using a recording sheet of the same size as a recording sheet of non-fixed form size used in the past, it is possible to execute easily the acquisition of non-fixed form sizes without requiring the tedious task of scanning the recording sheet on the platen, without requiring the tedious task of measuring the size of recording sheet by passing the transfer sheet within the image forming apparatus without carrying out image formation, and also without the need for sensor that can measure accurately even recording sheets of non-fixed form sizes in the tray.

Second Operation Example

In the following, the operation of an image forming apparatus according to the present embodiment is described as a second example of operation referring to the flow chart of FIG. 7.

Here, the operations are explained when the user loads fresh recording sheets in a tray in which although non-fixed form size recording sheets can be loaded but which is the state in which the setting of non-fixed form size tray has not been made. Further, for the sake of convenience, a tray in this state will be called a non-fixed form size permissible tray.

In this case, as the tray attribute data of a non-fixed form size permissible tray, although it is possible to use recording sheets of non-fixed form sizes, the state of the setting as a non-fixed form size tray having not been made is retained by the CPU 101 in the information retention section 104.

Figure 7:
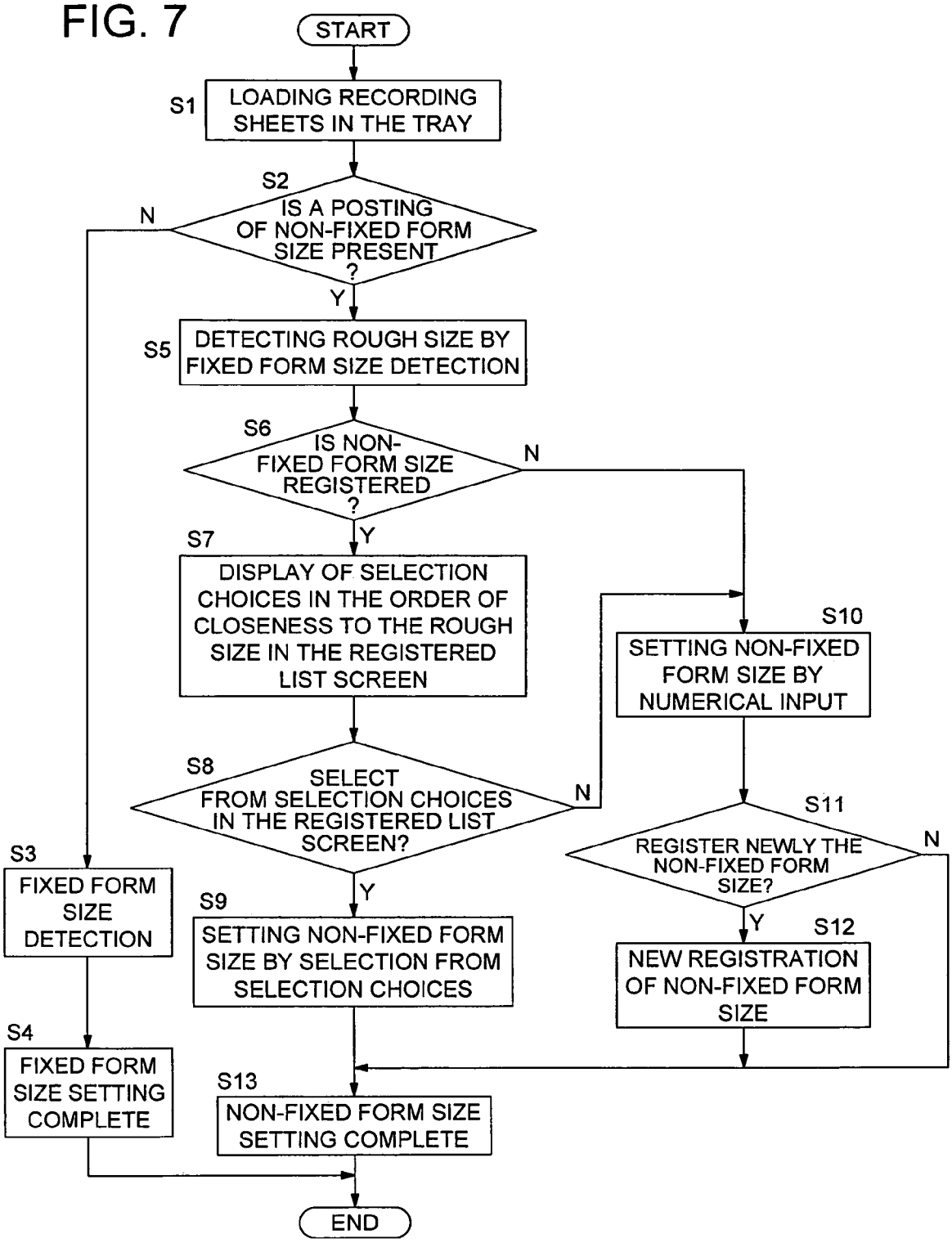
FIG. 7 shows a flowchart of operations performed in an image forming apparatus embodied in the present invention.

Here, consider that the user loads recording sheets in a non-fixed form size tray of the image forming apparatus (S1 in FIG. 7). Further, the "user" here is not limited to the actual user of the image forming apparatus, but denotes any and all persons who can carry out the work of replenishing recording sheets in the location where that image forming apparatus is installed.

The CPU 101 that has detected the drawing out and insertion of the non-fixed form size permissible tray from the main unit of the image forming apparatus, in the case when there is no intention indication by the user of having placed non-fixed form size recording sheets through the operation input section 102 (N in S2 in FIG. 7), if recording sheets are present in that tray, carries out a fixed form size detection for those recording sheets.

In other words, using the continuous data along the width direction of the recording sheet from the non-fixed form size permissible tray and from the rough resolution data along the longitudinal direction of the recording sheet, the CPU 101 carries out size detection (S3 in FIG. 7) in order to identify the size of fixed form size recording sheets. In the above manner, the CPU 101 completes the setting of fixed form size for recording sheets of fixed form size loaded in the non-fixed form size permissible tray (S4 in FIG. 7).

On the other hand, the CPU 101 that has detected the drawing out and insertion of the non-fixed form size permissible tray from the main unit of the image forming apparatus, in the case when there is an intention indication by the user of having placed non-fixed form size recording sheets through the operation input section 102 (Y in S2 in FIG. 7), if recording sheets are present in that tray, carries out a fixed form size detection for those recording sheets (S5 in FIG. 7). Further, here, since non-fixed form size recording sheets have been loaded in a non-fixed form size permissible tray, the fixed form size detection at this stage actually becomes a "rough size detection" of non-fixed form size recording sheets.

Here, the CPU 101 checks if the registration of recording sheets of non-fixed form size has already been made (S6 in FIG. 7). In actuality, the CPU 101 checks if non-fixed form size registration data is present in the information retention section 104.

Here, if non-fixed form size recording sheet registration has already been made (Y in S6 in FIG. 7), the CPU 101 refers to the rough size of the non-fixed form size recording sheet obtained earlier by executing the "rough size detection" mentioned above, and displays the non-fixed form sizes already registered as selection choices in an order nearest to the detected rough size (S7 in FIG. 7). Further, in this case, the non-fixed form sizes that are likely to be identical to the detected rough size and also that are in the order of closeness to the detected rough size are displayed as selection choices.

In this case, the CPU 101, first selects as selection choices the non-fixed form sizes that are likely to be identical to the rough size detected using the continuous data along the width direction of the recording sheet from the non-fixed form size permissible tray and from the rough resolution data along the longitudinal direction of the recording sheet. Next, the CPU 101, first refers to the continuous data along the width direction of the recording sheet from the non-fixed form size permissible tray, and arranges the selection choices, from among the selection choices of non-fixed form sizes, so that they are in the order of closeness to the rough size.

For example, the CPU 101 not only displays in the display section 103 the non-fixed form sizes already registered, as a list screen of registered sizes as shown in FIG. 5, but also, from among those non-fixed form sizes, the non-fixed form sizes that are likely to be identical to the detected rough size and also that are in the order of closeness to the detected rough size are displayed as selection choices.

In this example of FIG. 5, five non-fixed form sizes have been registered with their names assigned as "A4min(1)290×200", "A4min(2)285×199", "A4over300×215", "A3over430×300", and "A3over440×310".

Further, in this example of FIG. 5, the example is that of the case when the rear edge guide 1323 has been provided at a position corresponding to A4 size, and three non-fixed form sizes "A4min(1)290×200", "A4min(2)285×199", and "A4over300×215", are the non-fixed form sizes that are likely to be identical to the detected rough size and are being displayed as selection choices in the active state, and also the display is being made of selection choices in the order of their closeness to the detected rough size.

Further, in this example of FIG. 5, the two non-fixed form sizes "A3over430×300" and "A3over440×310" are the non-fixed form sizes that do not match with the detected rough size, and although they are being displayed as selection choices in the non-active state, and it is also possible to make them not displayed in the display screen of selection choices.

Further, the CPU 101, for the selection choices displayed in the display section 103 in this manner, accepts inputs from the operation input section 102 or the touch panel which is integral with the display section 103, and when any one of the selection choices is selected by the user (Y in S8 in FIG. 7) and the 'OK' icon is clicked, carries out the setting of the selected selection choices as the size of the recording sheets loaded in the tray (S9 in FIG. 7).

As a result of this, during image formation using non-fixed form size recording sheets, since the non-fixed form sizes registered beforehand are displayed as selection choices in the order of closeness to the rough size detected by the recording sheet size detection and can be selected, it is possible to carry out easily the acquisition of non-fixed form sizes.

Further, if a selection is not made from among the selection choices displayed in the display section 103 in this manner (N in S8 in FIG. 7), the user clicks the "numerical input" icon near the bottom center in FIG. 5.

In this case, the CPU 101, displays the numerical input screen as is shown in FIG. 6 in the display section 103, and accepts numerical inputs regarding the non-fixed form size from the operation input section 102 or the touch panel which is integral with the display section 103 (S10 in FIG. 7).

Further, according to the desire of the user (S11 in FIG. 7), it is also possible to carry out size registration (S12 in FIG. 7) for this non-fixed form size entered by numerical input. In other words, if the user desires that the non-fixed form size entered this time by numerical input has to be registered, the CPU 101 retains it as the registered data of non-fixed form sizes in the information retention section 104.

In the above manner, the CPU 101 completes the setting (S13 in FIG. 7) of the non-fixed form size regarding the size of the recording sheets loaded in the non-fixed form size permissible tray either by selection among the selection choices displayed in the selection choices display screen, or by setting using numerical input.

In the above manner, in image formation with indication from the user that recording sheets of non-fixed form sizes are to be used, since the non-fixed form sizes registered beforehand are displayed in the display section 103 as the selection choices in the order of closeness to the fixed form size detected by recording sheet size detection, and since the selection can be made from the operation input section 102, it is possible to execute easily the acquisition of non-fixed form sizes in an image forming apparatus such as a copying machine etc.

Further, because of the above operation, it is possible to execute easily the acquisition of non-fixed form sizes without requiring the tedious task of scanning the recording sheet on the platen, without requiring the tedious task of measuring the size of recording sheet by passing the transfer sheet within the image forming apparatus without carrying out image formation, and also without the need for sensor that can measure accurately even recording sheets of non-fixed form sizes in the tray.

Further, in the present example of operations, as a method of detecting that recording sheets have been loaded, the explanation was given of an example in which this is done based on the detection of withdrawing and inserting the tray from the main unit of the image forming apparatus, it is not necessary to restrict to this, but it is possible to provide a sensor that detects the presence or absence of the sheets on the tray, and this decision can be made based on detecting the change of the output signal of this sensor from the sheet absent state to the sheet present state.

Further, in the present example of operations, although the explanation has given of the example, regarding the detection of loading sheets of a non-fixed form size, in which this detection is made based on an input from the user via the operation input section 102, it is also possible to carry out the detection that the loaded sheet is a non-fixed form size sheet automatically by the image forming apparatus.

For example, the fact that the loaded sheet is of a non-fixed form size can be detected based on the data in the longitudinal direction of the recording sheet based on the rear edge guide 1323 and the data in the width direction of the recording sheet based on the side face guide plates 1321*a* and 1321*b*. In concrete terms, it is possible to judge that the sheet is of a non-fixed form size when the data along the width direction of the recording sheet is 210 mm, but the data along the longitudinal direction of the recording sheet is not equal to the length along the longitudinal direction of the recording sheet in the fixed form sizes corresponding to a length of 210 mm along the width direction of the recording sheet.

Further, in the case when the detection can be made in a linear manner even for the length along the longitudinal direction of the recording sheet similar to the length along the width direction of the recording sheet, it is also possible to judge that the size is a non-fixed form size if the data along the width direction of the recording sheet or the data along the longitudinal direction of the recording sheet is not equal to the length corresponding to a fixed form size.

Other Embodiments

In the above embodiments, although operation examples were described for a stand alone type image forming apparatus such as a copying machine provided with an operation input section 102 and a display section 103, the present invention shall not be deemed to be restricted to these embodiments. For example, the embodiments of the present invention can also be applied in the cases of printers operated by a computer equipment, or a network printer operated via a network, etc.

In other words, an interface 105 is provided that sends and receives information to and from another apparatus via a network, and the input of the selection that the tray is a non-fixed form size tray and of the selection from the selection choices is received from another apparatus via the network, and the selection choices are displayed in another apparatus via the network. That is to say, an operation input section (keyboard or pointing device) and a display section of another apparatus connected via the interface 105 are used.

Even in this case, when recording sheet is loaded in a tray set as a non-fixed form size tray, control of the detection of the recording sheet size of a non-fixed form size is carried out referring to the information from that tray, the non-fixed form sizes registered beforehand are displayed as selection choices in the display section of another apparatus in the order of their closeness to a fixed form size detected by the recording sheet size detection, and also control is carried out of receiving the selection among those selection choices from another apparatus.

As a result of this, in image formation using recording sheets of non-fixed form sizes, since the non-fixed form sizes registered beforehand are displayed in the display section of another apparatus as the selection choices in the order of closeness to the fixed form size detected by recording sheet size detection, and since the selection can be made from the operation input section of another apparatus, it is possible to execute easily the acquisition of non-fixed form sizes via a network when carrying out image formation in recording sheets of non-fixed form sizes.

Further, in the above embodiments, under the control of the CPU 101, the non-fixed form sizes that are likely to match with the detected rough size were made to be displayed as the selection choices, regarding the selection choice of non-fixed form size matching with the detected width of the recording sheet, it is possible to display that the degree of matching is high by changing the color or the flashing state. By doing so, it is possible to make the selection even more easily.

Further, in the above embodiments, although the explanations were given of examples in which the order is determined by giving priority to the length along the width direction of the recording sheet over the length along the longitudinal direction of the recording sheet, as the order of closeness to the rough size, the present invention shall not be restricted to this. As a method of determining the order of closeness to the rough size, it is possible to select appropriately considering the accuracy of detection of the length along the width direction of the recording sheet and the accuracy of detection of the length along the longitudinal direction of the recording sheet, and it is possible to determine the area based on the length along the width direction of the recording sheet and the length along the longitudinal direction of the recording sheet, are to determine the order by giving priority to the length along the longitudinal direction of the recording sheet over the length along the width direction of the recording sheet. As in the present embodiment, in the case of a configuration in which the length along the width direction of the recording sheet can be detected in a linear fashion and the length along the longitudinal direction of the recording sheet cannot be detected in a linear fashion, as in the present embodiment, by determining the order giving priority to the length along the width direction of the recording sheet over the length along the longitudinal direction of the recording sheet, it is possible to improve the accuracy of the order.

Further, in the above embodiments, although examples were given of displaying the selection choices in the order of closeness to the rough size, it is possible to make the selection by the user easy by merely displaying the non-fixed form sizes close to the rough size. For example, it is possible to have a configuration of displaying a plurality of selection choices close to the rough size in an order not related to their closeness to the rough size, or to have a configuration in which only one non-fixed form size that is closest to the rough size is displayed. Further, as in the present embodiment, by displaying the selection choices in the order of closeness to the rough size, it is possible to enhance the ease of selection by the user.

Further, in the above embodiments, although examples were given of displaying the sizes of non-fixed form size recording sheets and the names assigned to the sizes, as information corresponding to non-fixed form sizes, the information display can also be either only the size or only the name. For example, in the case when the user can judge the size from the name of the non-fixed form size recording sheet, by displaying only the name, it is possible to select the size of the non-fixed form size recording sheet. Further, by displaying the size it is possible to make higher accuracy selections.

The following effects can be obtained from the above embodiments.

When recording sheets of a non-fixed form size are loaded in a tray, since a rough size of said non-fixed form size recording sheet is acquired by carrying out control of recording sheet size detection of fixed form size by referring to the information from said tray, and since control is carried out of displaying the information corresponding to the non-fixed form sizes registered beforehand according to said rough size, it becomes possible to execute easily the acquisition of non-fixed form sizes.

Since control is carried out of displaying the non-fixed form sizes registered beforehand as the information corresponding to the non-fixed form sizes registered beforehand, it not only becomes possible to execute easily the acquisition of non-fixed form sizes, but also the user can identify easily the non-fixed form size close to the recording sheet of non-fixed form size loaded in the tray.

Since control is carried out of displaying the information corresponding to the non-fixed form sizes registered beforehand in the order of closeness to the rough size, it not only becomes possible to execute easily the acquisition of non-fixed form sizes, but also the user can identify still more easily the non-fixed form size close to the recording sheet of non-fixed form size loaded in the tray.

When the tray has been set as a non-fixed form size tray, since control is carried out of displaying the information corresponding to the non-fixed form sizes registered beforehand according to the magnitude of said rough size, it not only becomes possible to execute easily the acquisition of non-fixed form sizes, but also it is possible to enhance the convenience of use.

When a posting indicating that recording sheets of a non-fixed form size have been loaded in a tray is received, since control is carried out of displaying the information corresponding to the non-fixed form sizes registered beforehand according to said rough size, it not only becomes possible to execute easily the acquisition of non-fixed form sizes, but also it is possible to enhance the convenience of use.

When it is recognized that recording sheets of a non-fixed form size have been loaded in a tray, since control is carried out of displaying the information corresponding to the non-fixed form sizes registered beforehand according to the magnitude of said rough size, and since control is carried out of displaying the information corresponding to the non-fixed form sizes registered beforehand according to the rough size, it not only becomes possible to execute easily the acquisition of non-fixed form sizes, but also it is possible to enhance the convenience of use.

When non-fixed form size recording sheets are loaded in the tray, control is carried out of detecting the size of the recording sheets of fixed form size by referring to the information from the tray, when the rough size detected by the recording sheet size detection is different from the rough size corresponding to the non-fixed form size set currently for the tray, since control is carried out of displaying the information corresponding to the non-fixed form sizes registered beforehand according to the detected rough size, it not only becomes possible to execute easily the acquisition of non-fixed form sizes, but also it is possible to enhance the convenience of use.

Since the information corresponding to the non-fixed form sizes registered beforehand are displayed as the selection choices according to the rough size, and since control is carried out of receiving the selection among those selection choices, it is possible to execute easily the setting of non-fixed form sizes.

Since the setting of the size of the recording sheets of a non-fixed form size is made based on the selection among the selection choices, it is possible to execute easily the setting of non-fixed form sizes.

Since an operation input section that receives the inputs of the selection that the tray is a non-fixed form size tray and of the selection regarding the selection choices, and a display section that displays the selection choices are further provided, it is possible to execute easily the setting of non-fixed form sizes.

Since it is possible to accept the inputs of the selection that the tray is a non-fixed form size tray and of the selection regarding the selection choices from another apparatus via a network, and since it is possible to display the selection choices in another apparatus via a network, it is possible to enhance the convenience of use.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus for forming an image on a recording medium based on image data to output the recording medium on which the image is formed, comprising:

a tray on which a recording medium having an unfixed form size can be stacked;

a size detecting section to detect a size of a recording medium stacked on the tray;

an information retaining section to register the size of the recording medium having the unfixed form size therein;

a setting section to set the tray as either a fixed-form size tray or an unfixed-form size tray;

a display section to display unfixed form sizes registered in advance in the information retaining section; and a controller to acquire an approximate size of the recording medium having the unfixed form size by referring to information in regard to the size detected by the size detecting section, when the recording medium having the unfixed form size is stacked on the tray, which is currently set as the unfixed-form size tray;

wherein based on the approximate size, the controller controls the display section to display the unfixed form sizes registered in the information retaining section, in such a manner that the unfixed form sizes are displayed on a screen in order of size largeness while setting a size nearest to the approximate size at first, as choices for a user.

2. The image forming apparatus of claim 1, wherein the display section is provided with an operation inputting section to input various sizes therefrom; and wherein the unfixed form sizes, displayed on the screen of the display section as the choices, are selectable for the user, and it is possible for the user to input and set a size of the recording medium, having the unfixed form size, from the operation inputting section.

* * * * *